US006028529A

United States Patent [19]

Gotou

[11] Patent Number: 6,028,529

[45] Date of Patent: Feb. 22, 2000

[54] CLOCK CORRECTION FUNCTION FOR A RADIO SELECTIVE CALL RECEIVER WITH AN INTERMITTENT RECEIVER

[75] Inventor: Kazuhumi Gotou, Shizuoka, Japan

[73] Assignee: NEC Corporation, Tokyo, Japan

[21] Appl. No.: 08/931,757

[22] Filed: Sep. 16, 1997

[30] Foreign Application Priority Data

Sep. 17, 1996 [JP] Japan ..... 8-245213

[51] Int. Cl.[7] ..... G08B 5/22

[52] U.S. Cl. ..... 340/825.44; 455/38.1

[58] Field of Search ..... 340/825.44, 825.22; 455/38.1, 38.2, 140, 526, 517, 575, 38.3, 343, 132, 574; 370/311, 312, 313; 1/1

[56] References Cited

U.S. PATENT DOCUMENTS

| | | | |
|---|---|---|---|
| 3,694,755 | 9/1972 | Ward | 455/38.3 |
| 4,518,961 | 5/1985 | Davis et al. | 340/825.44 |
| 4,668,949 | 5/1987 | Akahori et al. | 340/825.44 X |
| 4,872,005 | 10/1989 | Deluca et al. | 340/825.44 |
| 4,910,510 | 3/1990 | Davis et al. | 340/825.44 |
| 5,124,698 | 6/1992 | Mustonen | 340/825.44 |
| 5,406,272 | 4/1995 | Jang | 340/825.44 |
| 5,475,374 | 12/1995 | Moore | 340/825.22 |
| 5,530,911 | 6/1996 | Lerner et al. | 455/38.3 |
| 5,606,728 | 2/1997 | Keba et al. | 455/38.3 |
| 5,649,314 | 7/1997 | Yamada et al. | 455/343 |
| 5,722,065 | 2/1998 | Ito et al. | 455/38.3 |
| 5,739,762 | 4/1998 | Kuramatsu et al. | 340/825.44 X |
| 5,768,701 | 6/1998 | Asai | 455/343 |
| 5,832,366 | 11/1998 | Umetsu | 455/38.3 |

FOREIGN PATENT DOCUMENTS

| | | |
|---|---|---|
| 2-141034 | 5/1990 | Japan . |
| 3-29524 | 2/1991 | Japan . |
| 3-126332 | 5/1991 | Japan . |
| 6-69857 | 3/1994 | Japan . |
| 7-99680 | 4/1995 | Japan . |

*Primary Examiner*—Michael Horabik
*Assistant Examiner*—Jean B. Jeanglaude
*Attorney, Agent, or Firm*—Young & Thompson

[57] ABSTRACT

A radio selective call receiver includes a time-of-day clock, a radio system, a control processor including a decoder, and a CPU which controls the operations thereof including time correction of the time-of-day clock. The control processor controls the activating timing of the CPU by controlling the main clock signal. When the radio system does not perform a receiving operation, the CPU is activated to perform the time correction based on received time information. When the radio system is performing the receiving operation, the CPU waits until the receiving operation is completed and is then activated to perform the time correction based on the time information and a waiting time.

13 Claims, 3 Drawing Sheets

CLOCK CORRECTION FUNCTION FOR A RADIO SELECTIVE CALL RECEIVER WITH AN INTERMITTENT RECEIVER

BACKGROUND OF THE INVENTION

1. Field of the Invention

The present invention relates to a radio selective call receiver and, more specifically, to a radio selective call receiver which performs an intermittent receiving operation.

2. Description of the Related Art

In general, a radio selective call receiver such as a pager employs an intermittent receiving scheme so as to save the battery power. Further, there has been proposed a system which can stop supplying main clock pulses to a CPU during each receiving period to stabilize the radio receiving characteristic. In Japanese Patent Unexamined Publication No. 7-99680, for example, a portable data processing apparatus is provided with an I/O slot into which a radio pager can be detachably connected. When the radio pager receives a radio signal, the radio pager outputs a control signal to the data processing apparatus, and thereby the main clock signal supplied to the CPU of the data processing apparatus is stopped or decreases in frequency during the receiving period.

SUMMARY OF THE INVENTION

However, in the case where a radio selective call receiver intermittently receives time information including the correct time and date from the nearby radio base station of a mobile communications system, it is necessary to immediately correct the time of day displayed on screen using the received time information. Therefore, the CPU of the receiver has to be supplied with the main clock signal just after receiving the time information even during the receiving operation. This may raise the possibility that the harmonics of the main clock pulses adversely influence the radio sensitivity characteristics of the radio system.

An object of the present invention is to provide a radio selective call receiver which can provide the correct time of day at all times without effect on the receiving characteristics.

According to the invention, a radio selective call receiver includes a time-keeping circuit, a radio circuit and a first controller. The radio circuit intermittently receives a radio signal from a radio base station, the radio signal including time information. The first controller controls a plurality of operations of the radio selective call receiver, the operations including time correction of the time-keeping circuit. The radio selective call receiver further includes a second controller which controls the activating timing of the first controller as follows: when the radio circuit does not perform a receiving operation, the first controller is activated to perform the time correction based on the time information and, when the radio circuit is performing the receiving operation, the first controller waits until the radio circuit completes the receiving operation and is then activated to perform the time correction based on the time information and a waiting time.

In the case where the radio selective call receiver includes the time-keeping circuit, the radio circuit and a data processor which performs operations including the time correction according to a main clock signal, when the radio circuit does not perform a receiving operation, the main clock signal is supplied to the data processor to perform the time correction based on the time information and, when the radio circuit is performing the receiving operation, the main clock signal is not supplied to the data processor until the receiving operation is completed and, after the receiving operation has been completed, the main clock signal is supplied to the data processor to perform the time correction based on the time information and a waiting time during which the main clock signal is not supplied to the data processor.

DESCRIPTION OF THE PREFERRED EMBODIMENT

Figure 1:
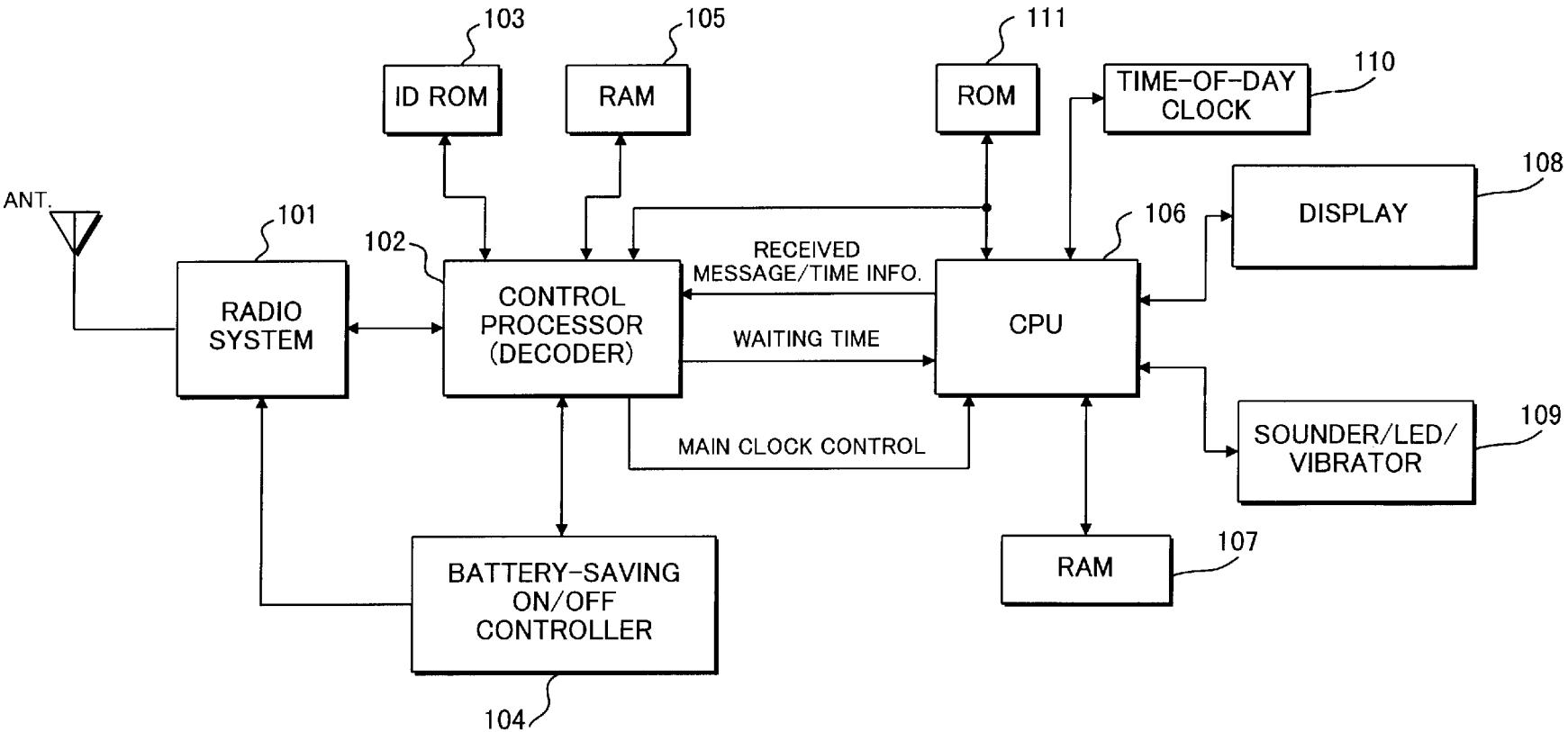
FIG. 1 is a block diagram showing a radio selective call receiver according to an embodiment of the present invention.

Referring to FIG. 1, a radio system 101 receives a radio signal from a radio base station (not shown) of a selective calling system through a built-in antenna. The radio base station transmits time information including the current time of day in predetermined periods as will be described later. The radio system 101 includes a demodulator which demodulates the received radio signal into a baseband signal. The baseband signal is transferred as a selective call signal from the radio system 101 to a control processor (or a decoder section) 102.

The control processor 102, when receiving the selective call signal from the radio system 101, decodes it into received data and then compares the selective calling number included in the received data with an identification (ID) number previously stored in an ID ROM 103 which may be an EEPROM (electrically-erasable programmable read-only memory). A battery-saving controller 104 performs the intermittent receiving control of the radio system 101 under the control of the control processor 102. The battery-saving controller 104 may be incorporated in the control processor 102.

Further, the control processor 102 uses a RAM (random access memory) 105 to store the time information received from the base station, if necessary, together with a waiting time obtained from the battery-saving controller 104. The time information is transferred to a CPU 106, if necessary, together with the waiting time as will be described later. The CPU 106 is provided with a main clock switch function which is controlled by the control processor 102. In this figure, a clock generator is not shown. More specifically, the main clock is supplied to the CPU 106 during the battery-saving ON period and is not supplied during the battery-saving OFF period. In other words, the CPU 106 is working according to the main clock while the radio system 101 is stopped operating and, contrarily, the CPU 106 stops working while the radio system 101 is operating.

When the selective calling number included in the received data is identical to the ID number, after the battery saving turns on, the control processor 102 outputs a received message included in the received data to the CPU 106 and then the message is stored onto a RAM 107. At the same time, the CPU 106 controls a display 108 and an informer 109 depending on user's instructions such that the message is displayed on the display 108 and the informer 109 informs a user by sound, vibration or light of an incoming call. In this figure, a keypad for inputting user's instructions is not shown.

Further, the CPU 106 is connected to an independent time-keeping circuit 110 such as a time-of-day clock or a clock/calendar and has a time correction function and a time-of-day displaying function to display the time and date on the display 108 according to a user's instruction. The CPU 106 performs the time correction using the time information and the waiting time received from the control processor 102, which will be described in detail.

A ROM 111 stores control programs which are used to perform the above control operations by the control processor 102 and the CPU 106.

Figure 2:
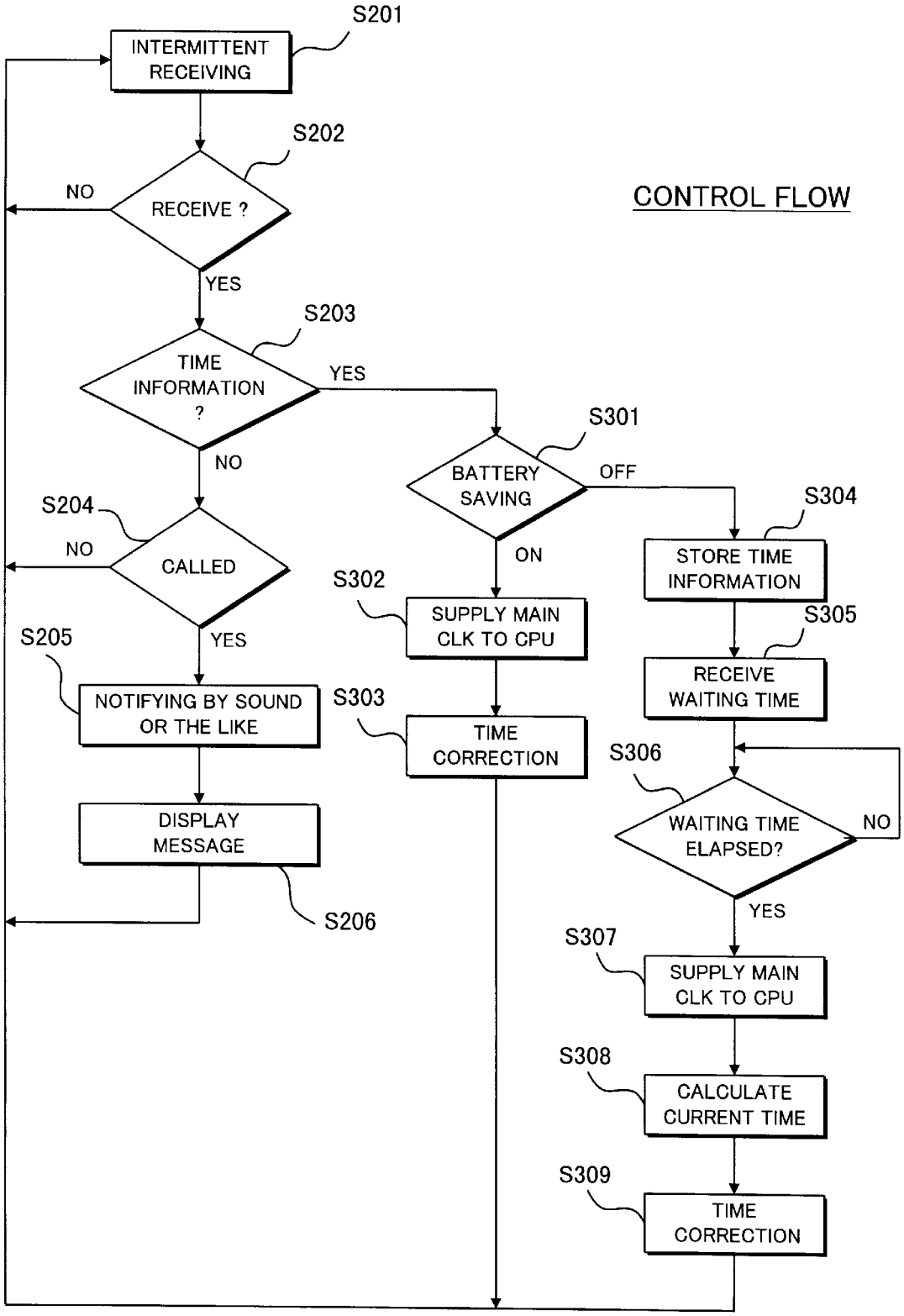
FIG. 2 is a flow chart showing the control operation of a control section in the embodiment.

Referring to FIG. 2, the radio system 101 performs the intermittently receiving operation under the control of the battery-saving controller 104 (step S201). When a radio signal is received (YES in step S202), the control processor 102 checks whether the received data includes time information (step S203). When the time information is not included (NO in step S203), the control processor 102 further checks whether the selective calling number included in the received data is identical to the ID number stored in the ID ROM 103 (step S204). If they are identical (YES in step S204), the main clock is supplied to the CPU 106 after the battery saving turns on, and thereby the CPU 106 instructs the informer 109 to inform a user by sound, vibration or light of an incoming call (step S205) and the display 108 to display the received message on screen (step S206).

When the received data includes time information (YES in step S203), the control processor 102 further checks whether the battery saving is on or off (step S301). If the battery saving is on, the main clock is being supplied to the CPU 106 (step S302). Therefore, the time correction is performed by the CPU 106 using the time information received (step S303).

If the battery saving is off, the control processor 102 stores the received time information onto the RAM 105 (step S304) and requests a waiting time from the battery-saving controller 104. The waiting time is the remaining time period until the battery-saving turns ON. When receiving the waiting time from the battery-saving controller 104 (step S305), the control processor 102 waits until the waiting time has elapsed (step S306). When the waiting time has elapsed (YES in step S306), the main clock is supplied to the CPU 106 (step S307) and then the CPU 106 calculates the current time by adding the waiting time to the received time information (step S308). Thus, the time correction is performed by the CPU 106 using the calculated current time (step S309).

The description of the steps S304–S309 will be made more specifically in the case of a synchronous system.

Figure 3:
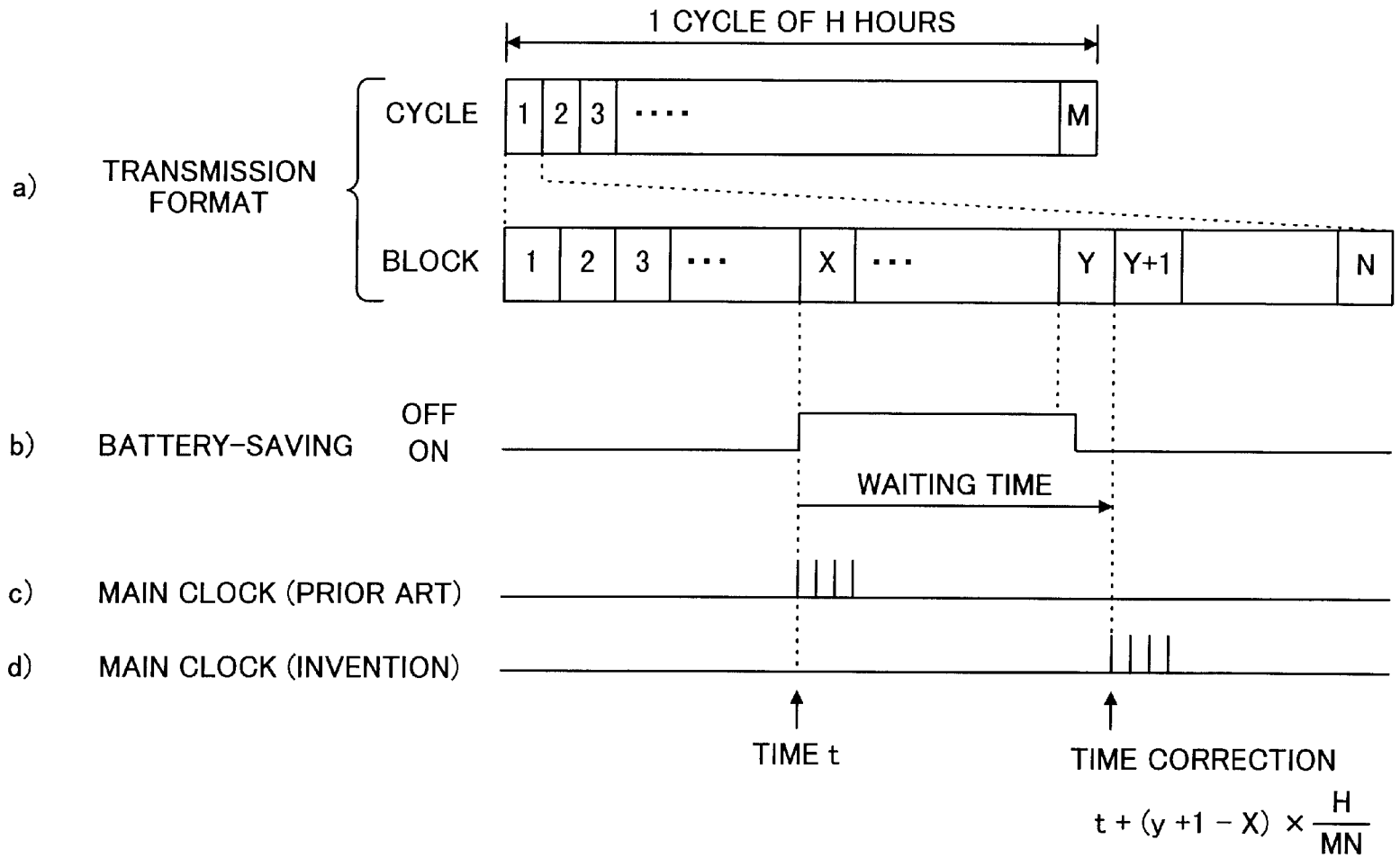
FIG. 3 is a time chart showing an operation of the embodiment of FIG. 1.

Referring to FIG. 3, a radio base station of the system transmits a transmission signal having the following format. A cycle of H hours consists of M frames each consisting of N blocks, wherein the time information is transmitted in a cycle of H hours, which are shown in (a) of the figure. Here, the time information T indicating a time of day, t, is transmitted in a block X. In the case where the radio system 101 is operating, that is, the battery saving is OFF when the control processor 102 has received the time information T, the control processor 102 transfers the received time information T to the RAM 105 and requests a waiting time from the battery-saving controller 104. In this figure, the waiting time is represented by the number of blocks, Y+1−X, from the block X to the block Y+1 as shown in (b) thereof.

After a lapse of the waiting time (Y+1−X), the control processor 102 outputs the main clock control signal to the CPU 106 and thereby the main clock is supplied to the CPU 106. At the same time, the control processor 102 outputs the time information T and the waiting time (Y+1−X) to the CPU 106. Using t and Y+1−X, the CPU 106 calculates the current time t+(Y+1−X)H/MN and thereby corrects the time of day displayed on screen as shown in (d) of FIG. 3.

In this manner, supplying the main clock to the CPU 106 waits until the battery saving turns ON and then the time correction is performed by the CPU using the current time calculated from the received time information and the waiting time. Therefore, the correct time is always displayed on screen without influencing the radio system 101.

In the case where the present invention is not employed, the main clock is supplied to the CPU 106 just after the time information T is received to perform the time correction as shown in (c) of FIG. 3. In this case, the main clock would adversely influence the receiving characteristics of the radio system 101 as described in the prior art.

What is claimed is:

1. A radio selective call receiver comprising:

a time-keeping circuit;

a radio circuit for intermittently receiving a radio signal from a radio base station, the radio signal including time information;

a first controller for controlling a plurality of operations of the radio selective call receiver, the operations including time correction of the time-keeping circuit; and a second controller for controlling activating timing of the first controller such that, when the radio circuit does not perform a receiving operation, the first controller is activated to perform the time correction based on the time information and, when the radio circuit is performing the receiving operation, the first controller waits until the radio circuit completes the receiving operation and is then activated to perform the time correction based on the time information and a waiting time.

2. The radio selective call receiver according to claim 1, wherein, after the radio circuit has completed the receiving operation, the first controller performs the time correction by calculating a current time from the time information and the waiting time received from the second controller.

3. The radio selective call receiver according to claim 1, wherein the radio signal is transmitted in a cycle of a predetermined period, the radio signal consisting of a predetermined number of synchronous blocks, wherein the second controller measures the waiting time by number of synchronous blocks from when the time information is received to when the receiving operation is completed.

4. A radio selective call receiver comprising:

a time-keeping circuit;

a radio circuit for intermittently receiving a radio signal from a radio base station, the radio signal including time information;

a data processor for processing data to perform a plurality of operations of the radio selective call receiver according to a main clock signal, the operations including time correction of the time-keeping circuit; and a controller for controlling the main clock signal to be supplied to the data processor such that, when the radio circuit does not perform a receiving operation, the main clock signal is supplied to the data processor to perform the time correction based on the time information and, when the radio circuit is performing the receiving operation, the main clock signal is not supplied to the data processor until the receiving operation is completed and, after the receiving operation has been completed, the main clock signal is supplied to the data processor to perform the time correction based on the time information and a waiting time during which the main clock signal is not supplied to the data processor.

5. The radio selective call receiver according to claim 4, wherein, after the receiving operation has been completed, the data processor performs the time correction by calculating a current time from the time information and the waiting time received from the controller according to the main clock signal.

6. The radio selective call receiver according to claim 4, wherein the radio signal is transmitted in a cycle of a predetermined period, the radio signal consisting of a predetermined number of synchronous blocks, wherein the controller measures the waiting time by number of synchronous blocks from when the time information is received to when the receiving operation is completed.

7. In a radio selective call receiver comprising:

a time-keeping circuit;

a radio circuit for intermittently receiving a radio signal from a radio base station, the radio signal including time information; and a main processor for processing data to perform a plurality of operations of the radio selective call receiver, the operations including time correction of the time-keeping circuit, a control method of the main processor, comprising the steps of:

determining whether the radio circuit is performing a receiving operation;

when the radio circuit does not perform the receiving operation, activating the main processor to perform the time correction based on the time information; and when the radio circuit is performing the receiving operation, waiting until the radio circuit completes the receiving operation and then activating the main processor to perform the time correction based on the time information and a waiting time.

8. The control method according to claim 7, wherein, after the radio circuit has completed the receiving operation, the main processor performs the time correction by calculating a current time from the time information and the waiting time.

9. The control method according to claim 7, wherein the radio signal is transmitted in a cycle of a predetermined period, the radio signal consisting of a predetermined number of synchronous blocks, wherein the waiting time is represented by number of synchronous blocks from when the time information is received to when the receiving operation is completed.

10. In a radio selective call receiver comprising:

a time-keeping circuit;

a radio circuit for intermittently receiving a radio signal from a radio base station, the radio signal including time information; and a data processor for processing data to perform a plurality of operations of the radio selective call receiver according to a main clock signal, the operations including time correction of the time-keeping circuit, a time correction method comprising the steps of:

determining whether the radio circuit is performing a receiving operation;

when the receiving operation is not performed, correcting the time-keeping circuit based on the time information by supplying the main clock signal to the main processor;

when the receiving operation is performed, producing a waiting time from when the time information is received to when the receiving operation is completed; and when the receiving operation is completed, correcting the time-keeping circuit based on the time information and the waiting time by supplying the main clock signal to the data processor.

11. The time correction method according to claim 10, wherein, after the receiving operation has been completed, the data processor performs the time correction by calculating a current time from the time information and the waiting time according to the main clock signal.

12. The radio selective call receiver according to claim 1, wherein the second controller normally controls the activating timing of the first controller such that, when the radio circuit does not perform the receiving operation, the first controller is activated and, when the radio circuit is performing the receiving operation, the first controller is deactivated.

13. The radio selective call receiver according to claim 4, wherein the controller normally controls the main clock signal such that, when the radio circuit does not perform the receiving operation, the main clock signal is supplied to the data processor and, when the radio circuit is performing the receiving operation, the main clock signal is not supplied to the data processor.

* * * * *